US006396468B2

(12) United States Patent
Matsushima et al.

(10) Patent No.: US 6,396,468 B2
(45) **Date of Patent: *May 28, 2002**

(54) LIQUID CRYSTAL DISPLAY DEVICE

(75) Inventors: Yasuhiro Matsushima, Kashihara; Sunao Etoh, Tenri, both of (JP)

(73) Assignee: Sharp Kabushiki Kaisha, Osaka (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/150,028

(22) Filed: Sep. 9, 1998

(30) Foreign Application Priority Data

Sep. 26, 1997 (JP) ..... 9-261507
May 25, 1998 (JP) ..... 10-142418

(51) Int. Cl.[7] ..... G09G 3/20

(52) U.S. Cl. ..... 345/87; 345/92; 345/100; 345/103; 345/208; 345/209; 348/792; 349/37

(58) Field of Search ..... 345/87, 92, 100, 345/103, 208, 209; 348/792; 349/37

(56) References Cited

U.S. PATENT DOCUMENTS 4,782,337 A * 11/1988 Clerc et al. ..... 345/93
4,842,371 A * 6/1989 Yasuda et al. ..... 345/96
5,093,655 A * 3/1992 Tanioka et al. ..... 345/96
5,298,914 A * 3/1994 Yamazaki ..... 345/103
5,489,919 A * 2/1996 Kuwata et al. ..... 345/100
5,508,716 A * 4/1996 Prince et al. ..... 345/103
5,519,411 A * 5/1996 Okada et al. ..... 345/89
5,682,177 A * 10/1997 Kuwata et al. ..... 345/100
5,734,365 A * 3/1998 Ohno et al. ..... 345/97
5,748,165 A * 5/1998 Kubota et al. ..... 345/96
5,790,092 A * 8/1998 Moriyama ..... 345/96
5,907,314 A * 5/1999 Negishi et al. ..... 345/103
6,031,513 A * 2/2000 Ikeda ..... 345/92
6,067,066 A * 5/2000 Kubota et al. ..... 345/98

FOREIGN PATENT DOCUMENTS

JP 7-113819 B2 12/1995

* cited by examiner

*Primary Examiner*—Bipin Shalwala
*Assistant Examiner*—Vincent E. Kovalick
(74) *Attorney, Agent, or Firm*—Nixon & Vanderhye P.C.

(57) ABSTRACT

A liquid crystal display device includes a liquid crystal between a substrate having gate buslines, source buslines, switching elements, pixel electrode array, gate driver, source driver, etc., and a substrate having a counter electrode, etc. In this liquid crystal display device, the gate driver performs simultaneous two-line scanning by applying a scanning signal to two gate buslines simultaneously. The source driver feeds video signals of opposite polarities to adjacent source buslines, respectively. The video signals are inverted every vertical scanning period.

29 Claims, 10 Drawing Sheets

FIG.5(a)

| | $S_1$ | $S_2$ | $S_3$ | $S_4$ | $S_5$ | $S_6$ |
|---|---|---|---|---|---|---|
| $G_1$ | + | − | + | − | + | − |
| $G_2$ | − | + | − | + | − | + |
| $G_3$ | + | − | + | − | + | − |
| $G_4$ | − | + | − | + | − | + |
| $G_5$ | + | − | + | − | + | − |
| $G_6$ | − | + | − | + | − | + |

FIG.5(b)

| | $S_1$ | $S_2$ | $S_3$ | $S_4$ | $S_5$ | $S_6$ |
|---|---|---|---|---|---|---|
| $G_1$ | − | + | − | + | − | + |
| $G_2$ | + | − | + | − | + | − |
| $G_3$ | − | + | − | + | − | + |
| $G_4$ | + | − | + | − | + | − |
| $G_5$ | − | + | − | + | − | + |
| $G_6$ | + | − | + | − | + | − |

LIQUID CRYSTAL DISPLAY DEVICE

FIELD OF THE INVENTION

The present invention relates to a liquid crystal display device, more particularly to a liquid crystal display device adopting a driving method in which scanning signals are applied to two gate buslines simultaneously.

BACKGROUND OF THE INVENTION

In resent years, development of active-matrix liquid crystal display devices using thin-film transistors as switching elements for driving liquid crystals has been actively carried out. The following description will explain a liquid crystal display device integrated with a driver, as an example of the active-matrix liquid crystal display device.

FIG. 8 is a plan depiction of the liquid crystal display device integrated with a driver. In the liquid crystal display device integrated with a driver, as illustrated in FIG. 8, a gate driver 32, a source driver 33, and a thin film transistor (hereinafter referred to as "TFT") array section 34 are disposed on a substrate 31 made of glass or quartz.

The gate driver 32 includes a shift register 32*a* and a buffer 32*b*. The source driver 33 includes a shift register 33*a*, a buffer 33*b*, and analog switches 39 for sampling video lines 38.

In the TFT array section 34, a number of gate buslines 116 running from the gate driver 32 are arranged parallel to each other. A number of source buslines 120 running from the source driver 33 are arranged to cross the gate buslines 116 at right angles. Moreover, additional capacitance common lines 114 are arranged parallel to the gate buslines 116.

A TFT 35, a pixel 36, and an additional capacitor 37 are provided in each rectangular region enclosed by one gate busline 116, two adjacent source buslines 120, and one additional capacitance common line 114. The gate electrode of the TFT 35 is connected to the gate busline 116, while the source electrode thereof is connected to the source busline 120. A liquid crystal is sealed in a space between a pixel electrode connected to the drain electrode of the TFT 35 and a counter electrode, thereby forming a pixel 36. The additional capacitance common line 114 is connected to an electrode to which the counter electrode is connected.

As a scanning method used in such a liquid crystal display device integrated with a driver, the following methods are given. One example is a simple scanning method in which a selection signal is separately applied to each gate busline. Another example is a simultaneous two-line scanning method in which two gate buslines are simultaneously driven. Here, the simultaneous two-line scanning method will be explained with reference to FIG. 9.

According to the simultaneous two-line scanning method, in an odd-numbered field, first, scanning signals are simultaneously applied to the first and second gate buslines G1 and G2. Then, after a delay of one horizontal scanning period, scanning signals are simultaneously applied to the third and fourth gate buslines G3 and G4. Thus, scanning signals are simultaneously applied to an odd-numbered gate busline and the next (i.e., even-numbered) gate busline, and then to the subsequent odd-numbered gate buslines and even-numbered gate buslines in this manner successively.

On the other hand, in an even-numbered field, first, a scanning signal is applied to the first gate busline G1. Then, after a delay of one horizontal scanning period, scanning signals are simultaneously applied to the second and third gate buslines G2 and G4. Furthermore, scanning signals are simultaneously applied to the fourth and fifth gate buslines G4 and G5. Hence, in an even-numbered field, scanning signals are simultaneously applied to a combination of adjacent gate buslines which is different from a combination of adjacent gate buslines in an odd-numbered field.

Accordingly, the simultaneous two-line scanning method requires twice the gate buslines and pixels electrodes compared to the simple scanning method in which a scanning signal is separately applied to each gate busline. However, the simultaneous two-line scanning method provides images of high resolution according to an interlace method.

In this case, since there is a need to perform a.c. driving of the liquid crystal display device, positive and negative video signals are alternately applied to a single pixel electrode every other field, i.e., a positive video signal is applied to a pixel electrode in one field and a negative video signal is applied to the pixel electrode in the next field. However, when the polarities of the video signals to be applied to pixel electrodes forming one screen are inverted every field, the flicker increases. In order to solve such a problem, for example, Japanese publication of examined patent application (Tokukohei) No. 7-113819/1985 proposes a method of inverting the phases of the video signals every two gate buslines which are to be scanned simultaneously.

In the first field, as shown in FIG. 10(*a*), positive video signals (indicated by "+") are applied to the pixel electrodes connected to the first and second gate buslines G1 and G2 which are selected simultaneously. Meanwhile, negative video signals (indicated by "−") are applied to the pixel electrodes connected to the third and fourth gate buslines G3 and G4 which are selected simultaneously. Moreover, the positive video signals are applied to the pixel electrodes connected to the fifth and sixth gate buslines G5 and G6 which are selected simultaneously.

In the second field, as illustrated in FIG. 10(*b*), a positive video signal is applied to the pixel electrode connected to the first gate busline, negative video signals are applied to the pixel electrodes connected to the second and third gate buslines G2 and G3 which are selected simultaneously, and positive video signals are applied to the pixel electrodes connected to the fourth and fifth gate buslines G4 and G5 which are selected simultaneously.

In the third field, as shown in FIG. 10(*c*), video signals whose polarities are opposite to those applied in the first field are applied to the pixel electrodes connected to the respective gate buslines. In the fourth field, as shown in FIG. 10(*d*), video signals whose polarities are opposite to those applied in the second field are applied to the pixel electrodes connected to the respective gate buslines.

In the above-mentioned method, it is possible to reduce the flicker as compared to a method in which the polarities of the video signals to be applied to the pixel electrodes of one screen are inverted between positive (+) and negative (−) every field. However, according the above-mentioned method, the polarity of the pixel electrode connected to the first gate busline G1 changes every field in order of +, +, −,−. The polarity of the pixel electrode connected to the second gate busline G2 changes every field in order of +, −, −, +. The polarity of the pixel electrode connected to the third gate busline G3 changes every field in order of −, −, +, +. The polarity of the pixel electrode connected to the fourth gate busline G4 changes every field in order of −, +, +, −. Thus, since the cycle of inverting the polarities of the video signals applied to the respective pixel electrodes is four fields, flicker is generated. As a result, the liquid crystal display device exhibits unpleasant displays.

SUMMARY OF THE INVENTION

It is an object of the present invention to provide a liquid crystal display device capable of reducing flicker even when scanning signals are simultaneously applied to two gate buslines by a gate driver.

In order to achieve the above object, a liquid crystal display device of the present invention includes:

a first substrate having gate buslines, source buslines, switching elements which are arranged in the vicinity of intersections of the gate buslines and source buslines so as to form a matrix pattern, and a pixel electrode array formed by pixel electrodes connected to the switching elements;

a gate driver and a source driver, for driving the switching elements;

a second substrate having a counter electrode formed thereon; and a liquid crystal material sandwiched between the first and second substrates, wherein the gate driver applies scanning signals simultaneously to two gate buslines located adjacent to each other, and the source driver applies video signals of opposite polarities to adjacent source buslines, respectively, and inverts the polarities of the video signals every vertical scanning period.

According to this structure, the gate driver performs simultaneous two-line scanning by applying scanning signals simultaneously to two gate buslines located adjacent to each other, and the source driver applies video signals of opposite polarities to adjacent source buslines, respectively. Since the polarities of the video signals are inverted every vertical scanning period, the cycle of inverting the polarities of the video signals to be applied to the pixel electrodes is as short as two fields. Moreover, since the polarities of the video signals are inverted every source busline, the liquid crystal display device of the present invention can reduce flicker generated in the liquid crystal display device.

Moreover, the liquid crystal display device of the present invention is preferably arranged so that a plurality of video signal lines for feeding the video signals are provided, and the polarities of the video signals to be input to the video signal lines are inverted every vertical scanning period.

With this structure, since a plurality of video signal lines for feeding the video signals are provided, the polarities of the video signals to be input to the video signal lines can be inverted every vertical scanning period. Thus, in the liquid crystal display device of the present invention, there is no need to perform inversion of the polarities of the video signals every source busline which is required in a liquid crystal display device having a single video signal line.

Furthermore, the liquid crystal display device of the present invention is preferably arranged so that the polarities of the video signals to be applied to the pixel electrodes of adjacent columns of the pixel array are opposite to each other.

With this structure, since the polarities of the video signals to be applied to the pixel electrodes located adjacent to each other in a column direction of the pixel array are respectively inverted, the liquid crystal display device of the present invention can further reduce flicker as compared to a liquid crystal display device in which the polarities of the video signals are only inverted every source busline.

In addition, the liquid crystal display device of the present invention is preferably arranged so that the switching elements connected to the source buslines are positioned alternately on one side and the other side of the source buslines.

With this structure, since the positions of the switching elements with respect to the source buslines change alternately between the right side and left side of the source buslines every row, the connecting position of the switching elements to the pixel electrodes changes. Thus, this liquid crystal display device can easily invert the polarity in each pixel.

Besides, the liquid crystal display device of the present invention is preferably arranged so that the gate driver is formed on the first substrate.

With this structure, since the gate driver is formed on the substrate on which the switching elements are formed, it is not necessary to use a complicated external driver IC for scanning two gate buslines simultaneously. Hence, in this liquid crystal display device, it is possible to fabricate the gate driver in the process of forming the switching elements.

Additionally, the liquid crystal display device of the present invention is preferably arranged so that the gate driver includes a multiplexer which contributes to generation of scanning signals which scan gate buslines sequentially two gate buslines at a time.

With this structure, since the gate driver includes the multiplexer, the liquid crystal display device can reduce the number of external input terminals.

Moreover, the liquid crystal display device of the present invention is preferably arranged so that the gate driver includes, between a shift register and the multiplexer, a logical gate circuit for reducing the number of signals input to the multiplexer to a half.

With this structure, since the gate driver includes a logical gate circuit which reduces the number of output signals from the shift register to a half, the number of control signals input to the multiplexer is reduced.

Furthermore, the liquid crystal display device of the present invention is preferably arranged so that the multiplexer has four control terminals.

With this structure, since the number of control terminals of the multiplexer is four, the liquid crystal display device can simultaneously scan two gate buslines with the minimum number of control terminals of the multiplexer.

For a fuller understanding of the nature and advantages of the invention, reference should be made to the ensuing detailed description taken in conjunction with the accompanying drawings.

BRIEF DESCRIPTION OF THE DRAWINGS

FIGS. 5(*a*) and 5(*b*) are views for explaining the inversion of the polarities of video signals to be fed to the pixel electrodes of the liquid crystal display device of Embodiment 2 of the present invention.

DESCRIPTION OF THE PREFERRED EMBODIMENTS

[Embodiment 1]

Figure 1:
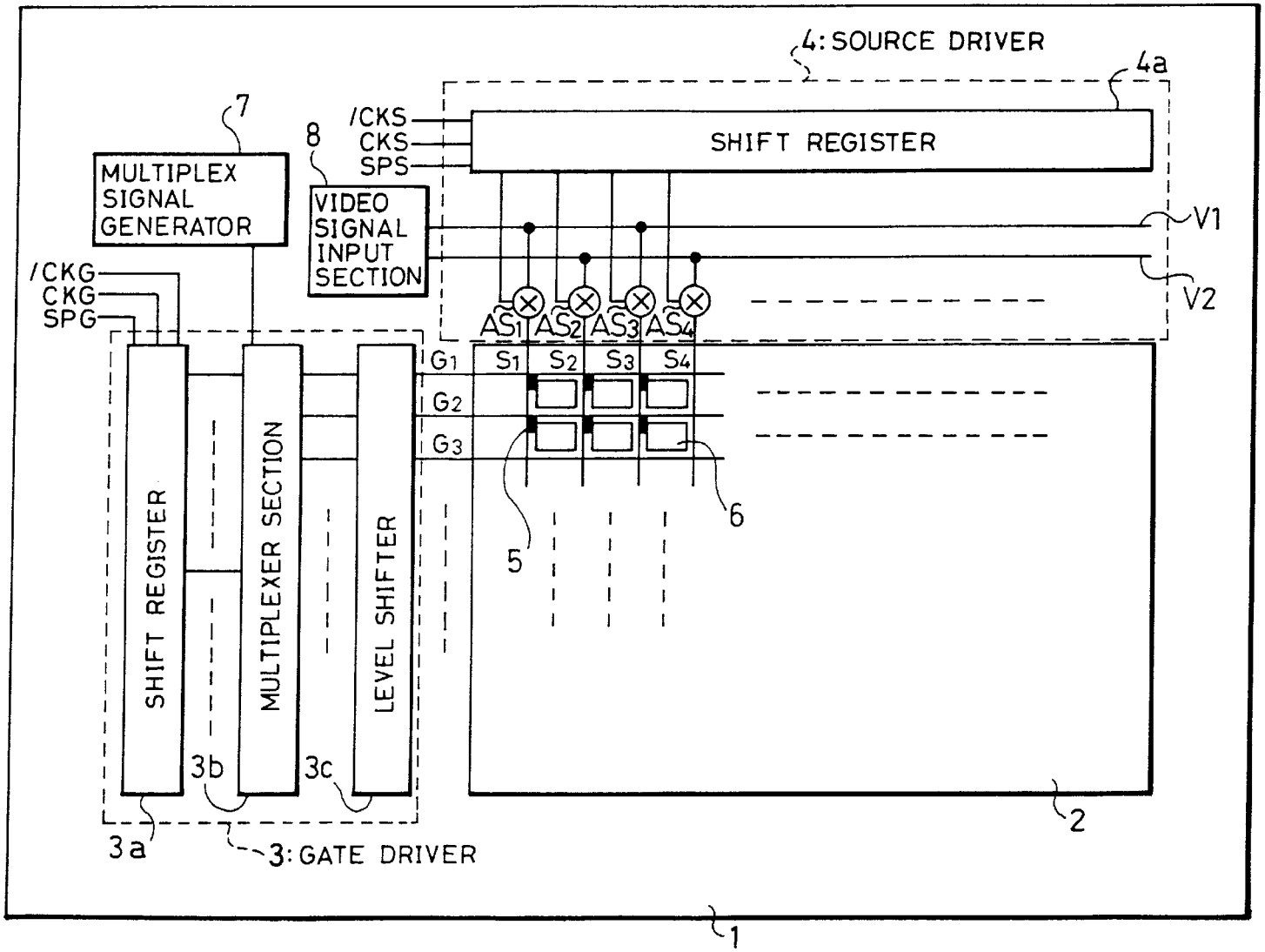
FIG. 1 is a view for explaining the structure of a liquid crystal display device according to Embodiment 1 of the present invention.
Figure 2:
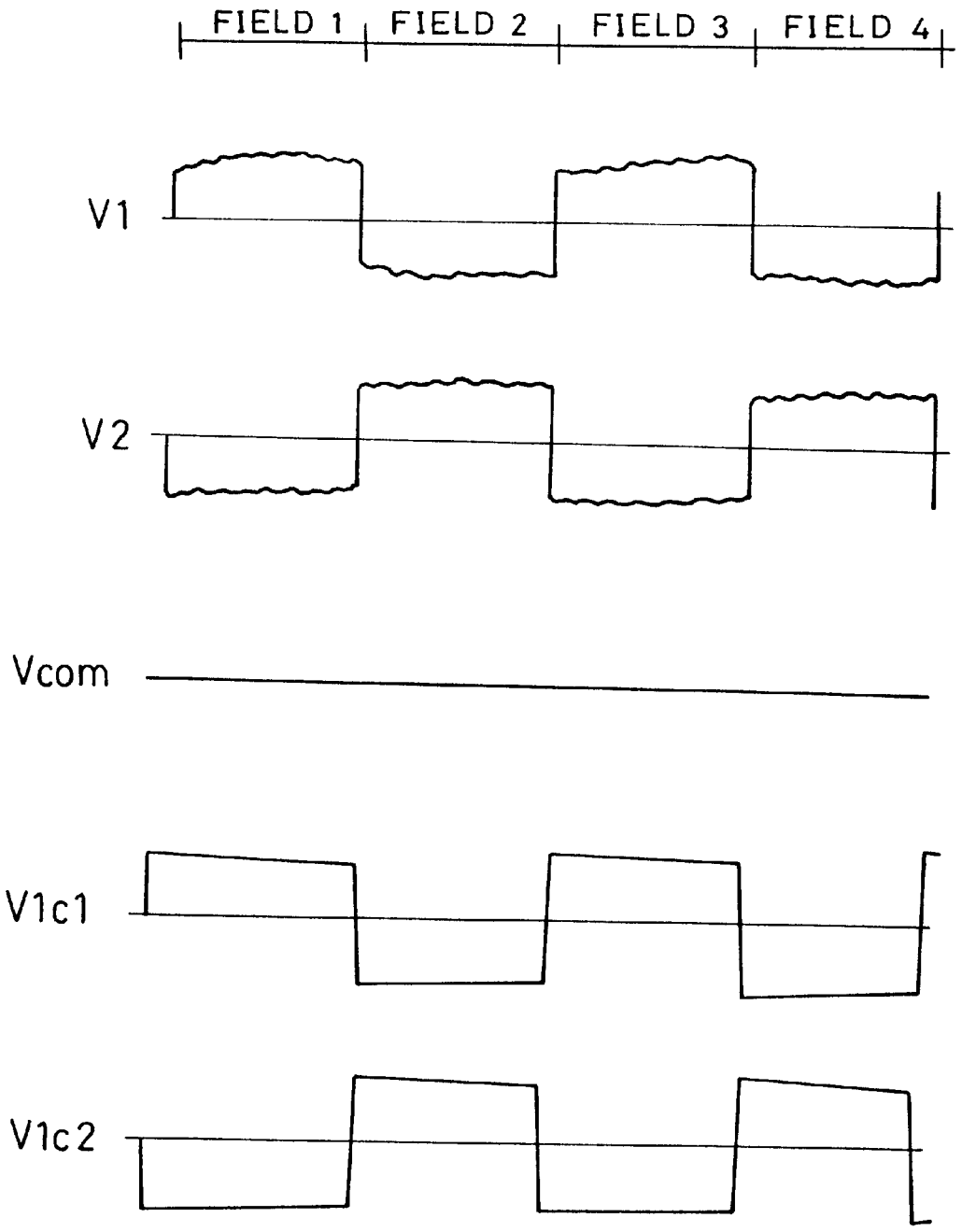
FIG. 2 is a waveform chart of voltages to be applied to video signal lines, a counter electrode, and pixel electrodes of the liquid crystal display device of Embodiment 1 of the present invention.
Figure 3A:
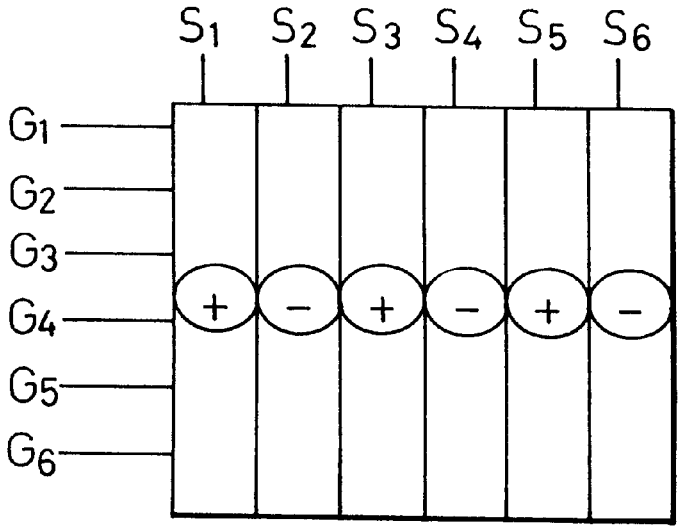
FIGS. 3(*a*) and 3(*b*) are views for explaining the inversion of the polarities of video signals to be fed to the source buslines of the liquid crystal display device of Embodiment 1 of the present invention.
Figure 3B:
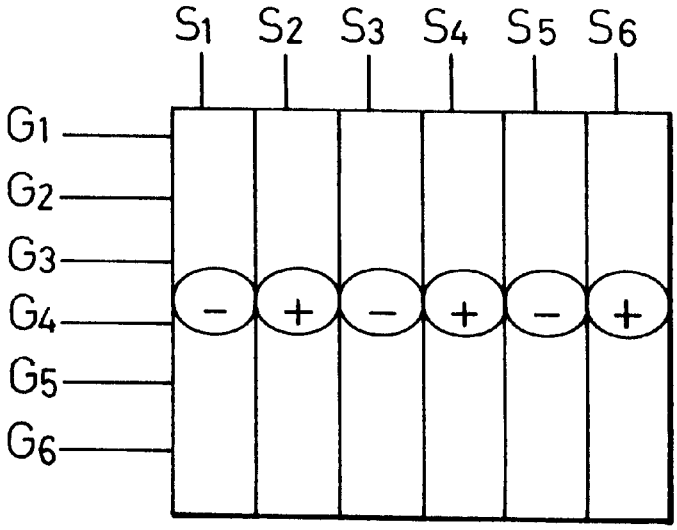

The following description will explain Embodiment 1 of the present invention with reference to FIGS. 1 to 3.

FIG. 1 illustrates the structure of a liquid crystal display device according to this embodiment. The liquid crystal display device of this embodiment includes thin film transistors (TFT) 5 as switching elements, which are arranged in a matrix form on an insulating transparent substrate 1 to form a TFT array 2. Formed on the insulating transparent substrate 1 are a gate driver 3 and source drive 4 for driving the TFT array 2. The gate driver 3 and source drive 4 are arranged on the periphery of the TFT array 2.

Gate buslines $G_1$, $G_2$, $G_3$ . . . are connected to the gate drivers 3, and source buslines $S_1$, $S_2$, $S_3$ . . . are connected to the source driver 4. One TFT 5 is disposed in the vicinity of each of the intersections of the gate buslines $G_1$, $G_2$, $G_3$ . . . and the source buslines $S_1$, $S_2$, $S_3$ . . .

How the TFTs 5 and pixel electrodes 6 are connected to the gate buslines $G_1$, $G_2$, $G_3$ . . . and the source buslines $S_1$, $S_2$, $S_3$ . . . will be explained below. In the following explanation, a TFT 5 connected to a gate busline $G_m$ and source busline $S_n$ is denoted by a TFT $\mathbf{5}_{(m,n)}$, and a pixel electrode 6 connected to a gate busline $G_m$ and source busline $S_n$ is denoted by a pixel electrode $\mathbf{6}_{(m,n)}$. Here, m and n are positive integers.

In this embodiment, the TFT $\mathbf{5}_{(m,n)}$ and pixel electrode $\mathbf{6}_{(m,n)}$ are placed in a region enclosed by gate buslines $G_m$ and $G_{m+1}$ and source buslines $S_n$ and $S_{n+1}$. The gate electrode of the TFT $\mathbf{5}_{(m,n)}$ is connected to the gate busline $G_m$, and the source electrode of the TFT $\mathbf{5}_{(m,n)}$ is connected to the source busline $S_n$. The drain electrode of the TFT $\mathbf{5}_{(m,n)}$ is connected to the pixel electrode $\mathbf{6}_{(m,n)}$.

In this embodiment, as shown in FIG. 1, the TFT $\mathbf{5}_{(m,n)}$ is positioned on the left side of the pixel electrode $\mathbf{6}_{(m,n)}$.

The gate driver 3 is formed by connecting a shift register 3*a*, a multiplexer section 3*b*, and a level shifter 3*c* successively. A start pulse SPG, clock signal CKG, and inverted clock signal /CKG as the inverted signal of the clock CKG are input to the shift register 3*a*. After the input of the start pulse SPG, the shift register 3*a* performs a sequence of operations in relation with the clock signal CKG, and outputs the signal to the multiplexer section 3*b*.

An output of the shift register 3*a* and an output of a multiplex signal generator 7 are input to the multiplexer section 3*b*. The multiplexer section 3*b* outputs a scanning-use signal for performing the simultaneous two-line scanning to the level shifter 3*c*. The scanning-use signal is output whenever the start pulse signal SPG is input. Namely, the scanning-use signal is output every scanning period.

The level shifter 3*c* increases the voltage of the scanning-use signal to, for example, 17 V, and feeds the resultant signal as a scanning signal to the gate buslines $G_1$, $G_2$, $G_3$ . . .

In an odd-numbered field, first, the gate buslines $G_1$ and $G_2$ are selected simultaneously by the scanning signal. Then, after a delay of one scanning period, the gate buslines $G_3$ and $G_4$ are selected simultaneously. Thus, an odd-numbered gate busline and the next even-numbered gate busline are simultaneously selected in sequence after each delay of one scanning period.

In an even-numbered field, first, the gate buslines $G_1$ is selected by the scanning signal. Then, after a delay of one scanning period, the gate buslines $G_2$ and $G_3$ are selected simultaneously. Thus, an even-numbered gate busline and the next odd-numbered gate busline are simultaneously selected in sequence after each delay of one scanning period.

The source driver 4 includes a shift register 4*a*, video signal lines V1, V2, and analog switches $AS_1$, $AS_2$ . . . The shift register 4*a* is connected to the analog switches $AS_1$, $AS_2$ . . . to control the analog switches $AS_1$, $AS_2$ . . . The video signal line V1 is connected to the odd-numbered source buslines $S_1$, $S_3$ . . . through the odd-numbered analog switches $AS_1$, $AS_3$ . . . The video signal line V2 is connected to the even-numbered source buslines $S_2$, $S_4$ . . . through the even-numbered analog switches $AS_2$, $AS_4$ . . .

A start pulse SPS, clock signal CKS, and inverted clock signal /CKS of the clock signal CKS are input to the shift register 4*a*.

After the input of the start pulse SPS, first, the analog switch $AS_1$ connected to the source busline $S_1$ is switched ON. Next, the analog switch $AS_2$ connected to the source busline $S_2$ is switched ON. Then, the analog switch $AS_3$ connected to the source busline $S_3$ is switched ON. Namely, a switching operation for switching analog switches $AS_1$, $AS_2$ . . . successively according to the start pulse SPS is repeated whenever one scanning period has passed.

A video signal input section 8 feeds a video signal to the video signal line V1, and a video signal produced by inverting the polarity of the video signal to the video signal line V2. The video signal input section 8 includes, for example, a non-inverting line (not shown) for outputting a video signal input to the video signal input section 8 as it is, and an inverting line (not shown) which branches off from the above non-inverting line, and is connected to an inverter (not shown) in series so that the video signal whose polarity is inverted is output from the output side of the inverter.

The video signal input section 8 can be constructed so that the output side of the non-inverting line is connected to the video signal line V1, and the output side of the inverting line is connected to the video signal line V2. The non-inverting line and inverting line can be formed on the insulating transparent substrate 1.

Since a.c. driving is essential for the liquid crystal display device, when the polarity of the video signal is positive in a field, it is negative in the next field, and positive in the following field. Namely, the polarity of the video signal is inverted every field.

FIG. 2 shows the voltage waveforms of the video signals V1 and V2 with respect to the respective fields of the liquid crystal display device of this embodiment.

As shown in FIG. 2, in an odd-numbered field, a video signal of positive polarity is fed to the video signal line V1, while a video signal of negative polarity is fed to the video signal line V2. The video signals fed to the video signal lines V1 and V2 are sampled according to the operations of the analog switches $AS_1$, $AS_2$ . . . The video signals are then fed as positive signals to the odd-numbered source buslines $S_1$, $S_3$ . . . and as negative signals to the even-numbered source buslines $S_2$, $S_4$ . . .

On the other hand, in an even-numbered field, a video signal of negative polarity is fed to the video signal line V1, while a video signal of positive polarity is fed to the video signal line V2. The video signals fed to the video signal lines V1 and V2 are sampled according to the operations of the analog switches $AS_1$, $AS_2$ . . . The polarity of the video signal in an even-numbered field is opposite to that of the video signal in the odd-numbered field, i.e., the video signals are fed as negative signals to the odd-numbered source buslines $S_1$, $S_3$ . . . and as positive signals to the even-numbered source buslines $S_2$, $S_4$ . . .

FIGS. 3(*a*) and 3(*b*) show the inversion of the polarity of the video signals to be fed to the source buslines $S_1$, $S_2$, $S_3$ . . . FIG. 3(*a*) shows the polarity of the video signals to be fed to the source buslines $S_1$, $S_2$, $S_3$ . . . in an odd-numbered field. FIG. 3(*b*) shows the polarity of the video signals to be fed to the source buslines $S_1$, $S_2$, $S_3$ . . . in an even-numbered field. In FIGS. 3(*a*) and 3(*b*), $G_1$, $G_2$, $G_3$ . . . indicate the gate buslines, and $S_1$ , $S_2$, $S_3$ . . . represent the source buslines. The symbols "+" and "−" in the ellipses show the polarities of the video signals to be fed to the respective source buslines.

As shown in FIG. 3(*a*), in an odd-numbered field, the video signals of positive polarity are applied to the odd-numbered source buslines $S_1$, $S_3$ . . ., and the video signals of negative polarity are applied to the even-numbered source buslines $S_2$, $S_4$ . . . On the other hand, as shown in FIG. 3(*b*), in an even-numbered field, the video signals of negative polarity are applied to the odd-numbered source buslines $S_1$, $S_3$ . . . , and the video signals of positive polarity are applied to the even-numbered source buslines $S_2$, $S_4$ . . .

When the TFT 5 is switched ON by the scanning signal output from the level shifter 3*c,* the TFT 5 feeds to the pixel electrode 6 the video signal to be sequentially applied to the source buslines $S_1$, $S_2$, $S_3$ . . .

Therefore, in an odd-numbered field, the video signals of positive polarity are applied to the pixel electrodes 6 connected to the odd-numbered source buslines $S_1$, $S_3$ . . ., while the video signals of negative polarity are applied to the pixel electrodes 6 connected to the even-numbered source buslines $S_2$, $S_4$ . . .

On the other hand, in an even-numbered field, the video signals of negative polarity are applied to the pixel electrodes 6 connected to the odd-numbered source buslines $S_1$, $S_3$ . . . while the video signals of positive polarity are applied to the pixel electrodes 6 connected to the even-numbered source buslines $S_2$, $S_4$ . . .

A transparent insulating counter substrate (not shown) is provided with a counter electrode. The liquid crystal display device of this embodiment is constructed by placing liquid crystal between the counter substrate and the transparent insulating substrate 1. A constant voltage is applied to the counter electrode. Therefore, the applied video signals are written in the pixel electrodes 6.

FIG. 2 shows the waveforms of a voltage Vcom to be applied to the counter electrode, a voltage Vlc1 to be applied to the pixel electrodes 6 connected to the odd-numbered source buslines $S_1$, $S_3$ . . ., and a voltage Vlc2 to be applied to the pixel electrodes 6 connected to the even-numbered source buslines $S_2$, $S_4$ . . .

As shown by Vlc1 of FIG. 2, the video signals of positive polarity are written to the pixel electrodes 6 connected to the odd-numbered source buslines $S_1$, $S_3$ . . . in an odd-numbered field, and the video signals of negative polarity are written to the pixel electrodes 6 connected to the even-numbered source buslines $S_2$, $S_4$ . . . in an even-numbered field.

Thus, in an odd-numbered field, as shown in FIG. 3(*a*), the video signals of positive polarity are applied to the odd-numbered source buslines $S_1$, $S_3$ . . . and written in the pixel electrodes 6, and the video signals of negative polarity are applied to the even-numbered source buslines $S_2$, $S_4$ . . . and written in the pixel electrodes 6. On the other hand, in an even-numbered field, as shown in FIG. 3(*b*), the video signals of negative polarity are applied to the odd-numbered source buslines $S_1$, $S_3$ . . . and written in the pixel electrodes 6, and the video signals of positive polarity are applied to the even-numbered source buslines $S_2$, $S_4$ . . . and written in the pixel electrodes 6.

As described above, the video signal of positive polarity and the video signal of negative polarity are alternately applied on a line by line basis to the source buslines $S_1$, $S_2$, $S_3$ . . . , and written in the pixel electrodes 6. Namely, the cycle of inverting the video signal to be written in the pixel electrode 6 is as short as two fields, and the polarity of the video signal is inverted every source busline. Therefore, even if the gate driver 3 scans two of the gate buslines $G_1$, $G_2$, $G_3$ . . . simultaneously, flicker does not increase.

As described above, in this embodiment, the gate driver 3 performs simultaneous two-line scanning by applying the scanning signal simultaneously to two of adjacent gate buslines $G_1$, $G_2$, $G_3$ . . . , and the source driver 4 applies the video signals of opposite polarities to adjacent source buslines $S_1$, $S_2$, $S_3$ . . . Moreover, since the polarity of the video signal is inverted every vertical scanning period, the cycle of inverting the polarity of the video signal to be applied to each pixel electrode is as short as two fields. Furthermore, since the polarity of the video signal is inverted every source busline, the liquid crystal display device of this embodiment can reduce flicker significantly.

In this embodiment, the gate driver 3 and the switching elements are formed on the same substrate. Therefore, the liquid crystal display device of this embodiment does not require a complicated external drive IC for scanning two of the gate buslines $G_1$, $G_2$, $G_3$ . . . simultaneously, and can fabricate the gate driver 3 in the process of forming the switching elements. In addition, since the gate driver 3 includes the multiplexer section 3*b,* the liquid crystal display device of this embodiment does not require a multiplex signal from an external device, thereby achieving a reduction in the number of the external input terminals.

[Embodiment 2]

Figure 4:
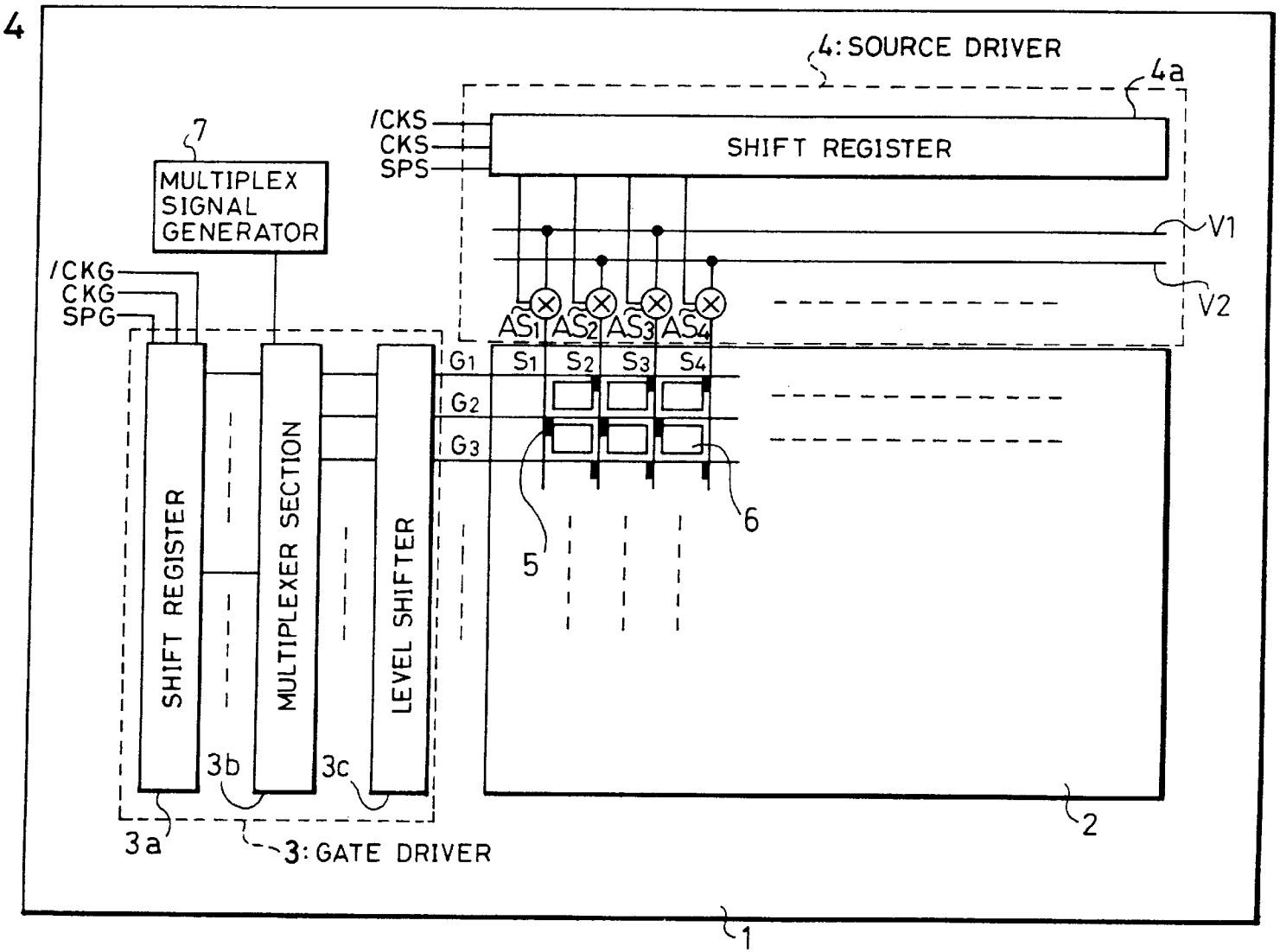
FIG. 4 is a view for explaining the structure of a liquid crystal display device according to Embodiment 2 of the present invention.

The following description will explain Embodiment 2 of the present invention with reference to FIGS. 4 and 5.

Referring to FIG. 4, a liquid crystal display device of this embodiment will be explained. This embodiment is the same as Embodiment 1 in respect of the structures of the gate driver 3 and source driver 4, and the arrangements of the gate buslines $G_1$, $G_2$, $G_3$ . . . , source buslines $S_1$, $S_2$, $S_3$ . . . , and pixel electrodes 6.

This embodiment differs from Embodiment 1 in that the positions of the TFTs 5 connected to the source buslines $S_1$, $S_2$, $S_3$ . . . are changed between the left side and right side of the source buslines $S_1$, $S_2$, $S_3$ . . . alternately every row. In other words, the TFT 5 is positioned on the left side of a source busline in a particular row, and the TFT 5 is placed on the right side of the source busline in the next row.

How the TFTs 5 and pixel electrodes 6 are connected to the gate buslines $G_1$, $G_2$, $G_3$ . . . and source buslines $S_1$, $S_2$, $S_3$ . . . will be explained below. In the following explanation, the TFT 5 and pixel electrode 6 positioned in a region enclosed by the gate buslines $G_m$, $G_{m+1}$ and the source buslines $S_n$, $S_{n+1}$ are denoted by the TFT $\mathbf{5}_{(m,n)}$ and pixel electrode $\mathbf{6}_{(m,n)}$, respectively. Here, m and n are positive integers.

As illustrated in FIG. 4, the electrodes of the TFT 5 of this embodiment are connected as follows. "i" and "j" in the following explanation are positive integers.

The gate electrode of the TFT $\mathbf{5}_{(2i-1,\ 2j-1)}$ positioned in an odd-numbered row and odd-numbered column is connected to the gate busline $G_{2i-1}$. The source electrode of the TFT $\mathbf{5}_{(2i-1,\ 2j-1)}$ is connected to the source busline $S_{2j}$. The drain electrode of the TFT $\mathbf{5}_{(2i-1,\ 2j-1)}$ is connected to the pixel electrode $\mathbf{6}_{(2i-1,\ 2j-1)}$.

The gate electrode of the TFT $\mathbf{5}_{(2i-1,\ 2j)}$ positioned in an odd-numbered row and even-numbered column is connected to the gate busline $G_{2i-1}$. The source electrode of the TFT $\mathbf{5}_{(2i-1,\ 2j)}$ is connected to the source busline $S_{2j+1}$. The drain electrode of the TFT $\mathbf{5}_{(2i-1,\ 2j)}$ is connected to the pixel electrode $\mathbf{6}_{(2i-1,\ 2j)}$.

The gate electrode of the TFT $\mathbf{5}_{(2i,\ 2j-1)}$ positioned in an even-numbered row and odd-numbered column is connected to the gate busline $G_{2i}$. The source electrode of the TFT $\mathbf{5}_{(2i,\ 2j-1)}$ is connected to the source busline $S_{2j-1}$. The drain electrode of the TFT $\mathbf{5}_{(2i,\ 2j-1)}$ is connected to the pixel electrode $\mathbf{6}_{(2i,\ 2j-l)}$.

The gate electrode of the TFT $\mathbf{5}_{(2i,\ 2j)}$ positioned in an even-numbered row and even-numbered column is connected to the gate busline $G_{2i}$. The source electrode of the TFT $\mathbf{5}_{(2i,\ 2j)}$ is connected to the source busline $S_{2j}$. The drain electrode of the TFT $\mathbf{5}_{(2i,\ 2j)}$ is connected to the pixel electrode $\mathbf{6}_{(2i,\ 2j)}$.

Since no pixel electrode 6 is positioned on the left side of the source busline $S_1$ in the first column and on the right side of the source busline in the last column, the source electrode of the TFT 5 is not connected to the left side of the source busline $S_1$ in the first column and the right side of the source busline in the last column.

As described above, the positions of the TFTs 5 connected to the respective source buslines $S_2$, $S_3$, $S_4$ . . . , except those connected to the source busline $S_1$ in the first column and the source busline in the last column, with respect to the respective source buslines change alternately between one side and the other side of the respective source buslines every row.

A video signal input section (not shown) outputs a video signal of negative polarity to the video signal line V1 and a video signal of positive polarity to the video signal line V2 in an odd-numbered field. On the other hand, the video signal input section outputs a video signal of positive polarity to the video signal line V1 and a video signal of negative polarity to the video signal line V2 in an even-numbered field.

The video signal input section outputs to the video signal lines V1 and V2 video signals of polarities opposite to those of Embodiment 1, respectively. Here, the polarity of the video signal to be output to each of the video signal lines V1 and V2 is inverted every field like Embodiment 1. Therefore, the video signal input section can be achieved by connecting the output terminals of the video signal input section 8 of Embodiment 1 to the video signal lines V1 and V2 in the opposite way.

FIGS. 5(*a*) and 5(*b*) show the polarities of the video signals to be applied to the pixel electrodes 6 of the liquid crystal display device of this embodiment. In FIGS. 5(*a*) and 5(*b*), $S_1$, $S_2$, $S_3$ . . . represent source buslines, and $G_1$, $G_2$, $G_3$ . . . are gate buslines. The symbols "+" and "−" in the rectangles enclosed by the source buslines and gate buslines which intersect each other indicate the polarities of the video signals to be fed to the pixel electrodes 6.

In this embodiment, in an odd-numbered field, the video signals of positive polarity are fed to the source buslines $S_2$, $S_4$, $S_6$ . . . in even-numbered columns. As shown in FIG. 5(*a*), the video signals of positive polarity are applied to the pixel electrodes 6 of the odd-numbered rows and odd-numbered columns through the TFTs 5 of the odd-numbered rows and odd-numbered columns, and to the pixel electrodes 6 of the even-numbered rows and even-numbered columns through the TFTs 5 of the even-numbered rows and even-numbered columns. On the other hand, the video signals of negative polarity are fed to the source buslines $S_1$, $S_3$, $S_5$ . . . in odd-numbered columns. As shown in FIG. 5(*a*), the video signals of negative polarity are fed to the pixel electrodes 6 of odd-numbered rows and odd-numbered columns through the TFTs 5 of the odd-numbered rows and even-numbered columns, and to the pixel electrodes 6 of even-numbered rows and even-numbered columns through the TFTs 5 of the even-numbered rows and odd-numbered columns.

One of the pixel electrodes 6 located in adjacent rows is connected to the odd-numbered source busline such as $S_1$, $S_3$, $S_5$ . . ., and the other pixel electrode 6 is connected to the even-numbered source busline such as $S_2$, $S_4$, $S_6$ . . . Namely, video signals of opposite polarities are fed to the pixel electrodes 6 located in adjacent rows. Meanwhile, one of the pixel electrodes 6 located in adjacent columns is connected to the odd-numbered source busline such as $S_1$, $S_3$, $S_5$ . . . , and the other pixel electrode 6 is connected to the even-numbered source busline such as $S_2$, $S_4$, $S_6$ . . . Thus, video signals of opposite polarities are fed to the pixel electrodes 6 located in adjacent columns.

As described above, the polarity of the video signal applied to a particular pixel electrode 6 and that of the video signal applied to the pixel electrode 6 adjacent to the particular pixel are opposite.

In this embodiment, in an even-numbered field, the video signals of negative polarity are fed to the source buslines $S_2$, $S_4$, $S_6$ . . . in the even-numbered columns. As shown in FIG. 5(*b*), the video signals of negative polarity are applied to the pixel electrodes 6 of the odd-numbered rows and odd-numbered columns through the TFTs 5 of the odd-numbered rows and odd-numbered columns, and to the pixel electrodes 6 of the even-numbered rows and even-numbered columns through the TFTs 5 of the even-numbered rows and even-numbered columns. On the other hand, the video signals of positive polarity are fed to the source buslines $S_1$, $S_3$, $S_5$ . . . in the odd-numbered columns. As shown in FIG. 5(*b*), the video signals of positive polarity are fed to the pixel electrodes 6 of odd-numbered rows and odd-numbered columns through the TFTs 5 of the odd-numbered rows and odd-numbered columns, and to the pixel electrodes 6 of even-numbered rows and odd-numbered columns through the TFTs 5 of the even-numbered rows and odd-numbered columns. Hence, similarly to an odd-number field, the video signals fed to adjacent pixel electrodes 6 have opposite polarities.

Considering the polarity of the video signal fed to a particular pixel electrode 6, for example, the polarity of the pixel electrode located in the first row and first column, as shown in FIGS. 5(*a*) and 5(*b*), the video signal of positive polarity is fed in an odd-numbered field, and the video signal of negative polarity is fed in an even-numbered field. Thus, the liquid crystal display device of this embodiment can invert the polarity every pixel.

As described above, the liquid crystal display device of this embodiment can invert the polarity of video signal every pixel rather than inverting the video signal every source busline, i.e., every column of pixels, like the liquid crystal display device of Embodiment 1.

As described above, the liquid crystal display device of this embodiment can further reduce flicker as compared to the liquid crystal display device of Embodiment 1. Moreover, inversion of the polarity of the video signal to be applied in a column direction is achieved by changing the position and connection of the TFTs with respect to the source buslines.

[Embodiment 3]

Figure 6:
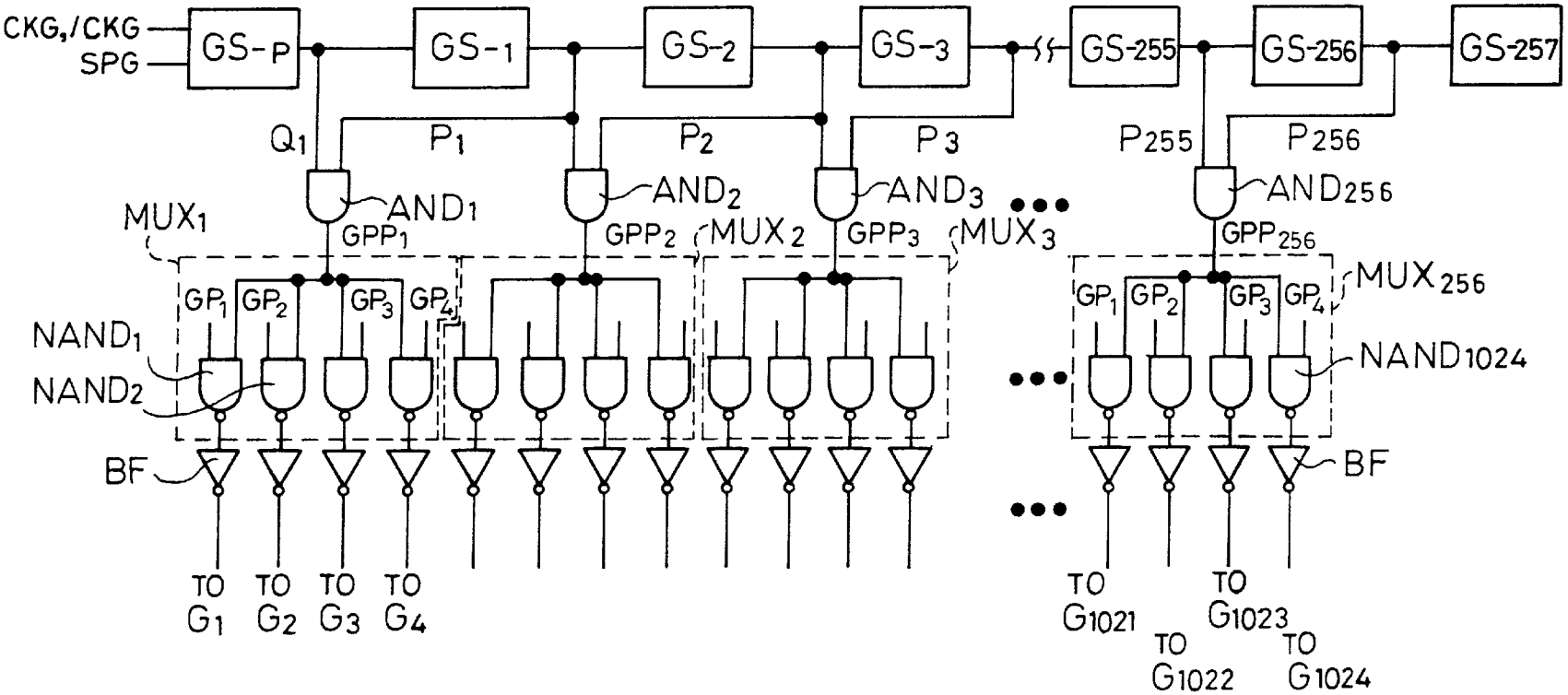
FIG. 6 is a view for explaining the structure of a liquid crystal display device according to Embodiment 3 of the present invention.
Figure 7:
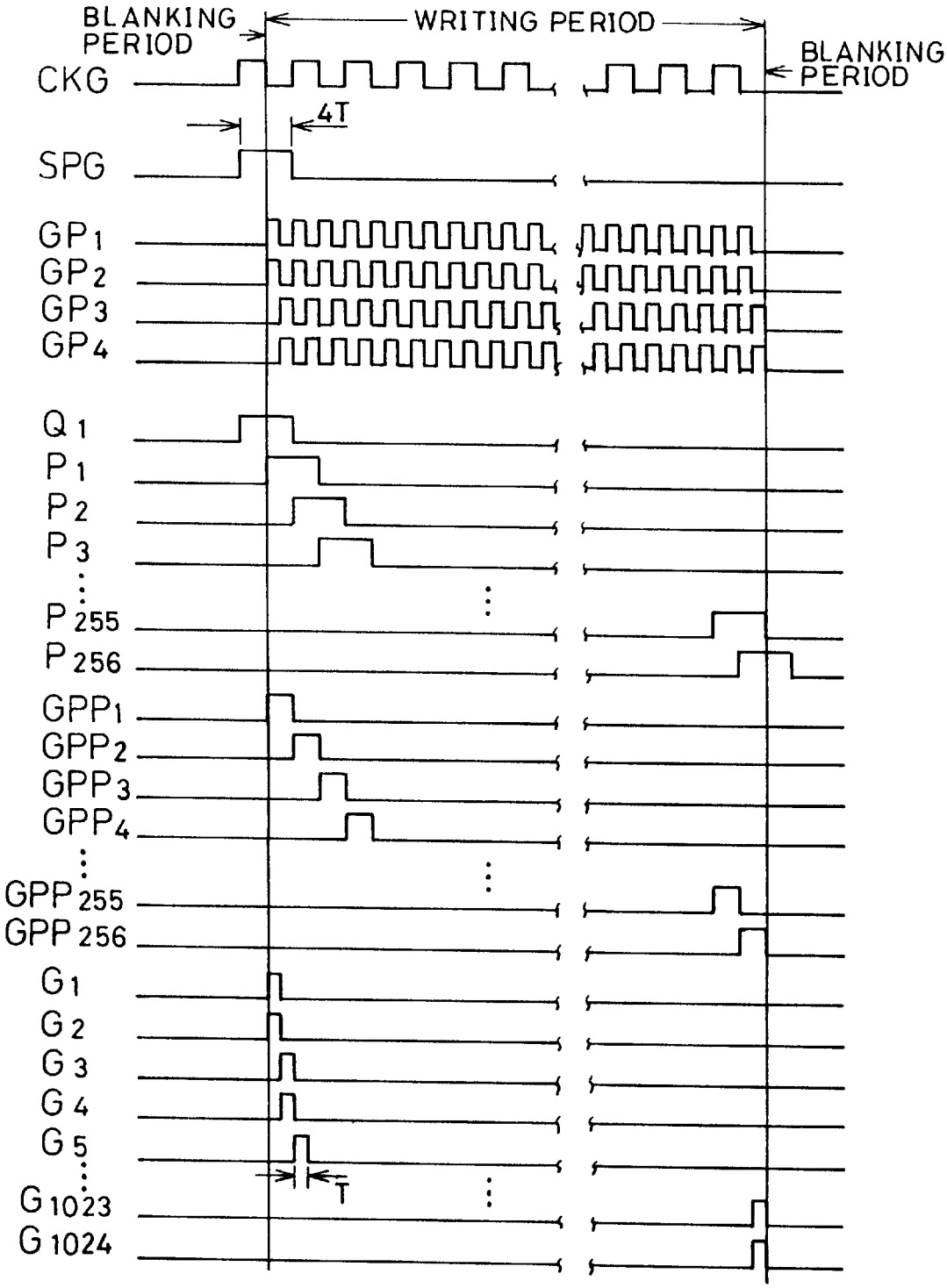
FIG. 7 is a timing chart showing various signals relating to driving of the liquid crystal display device of Embodiment 3 of the present invention.
Figure 8:
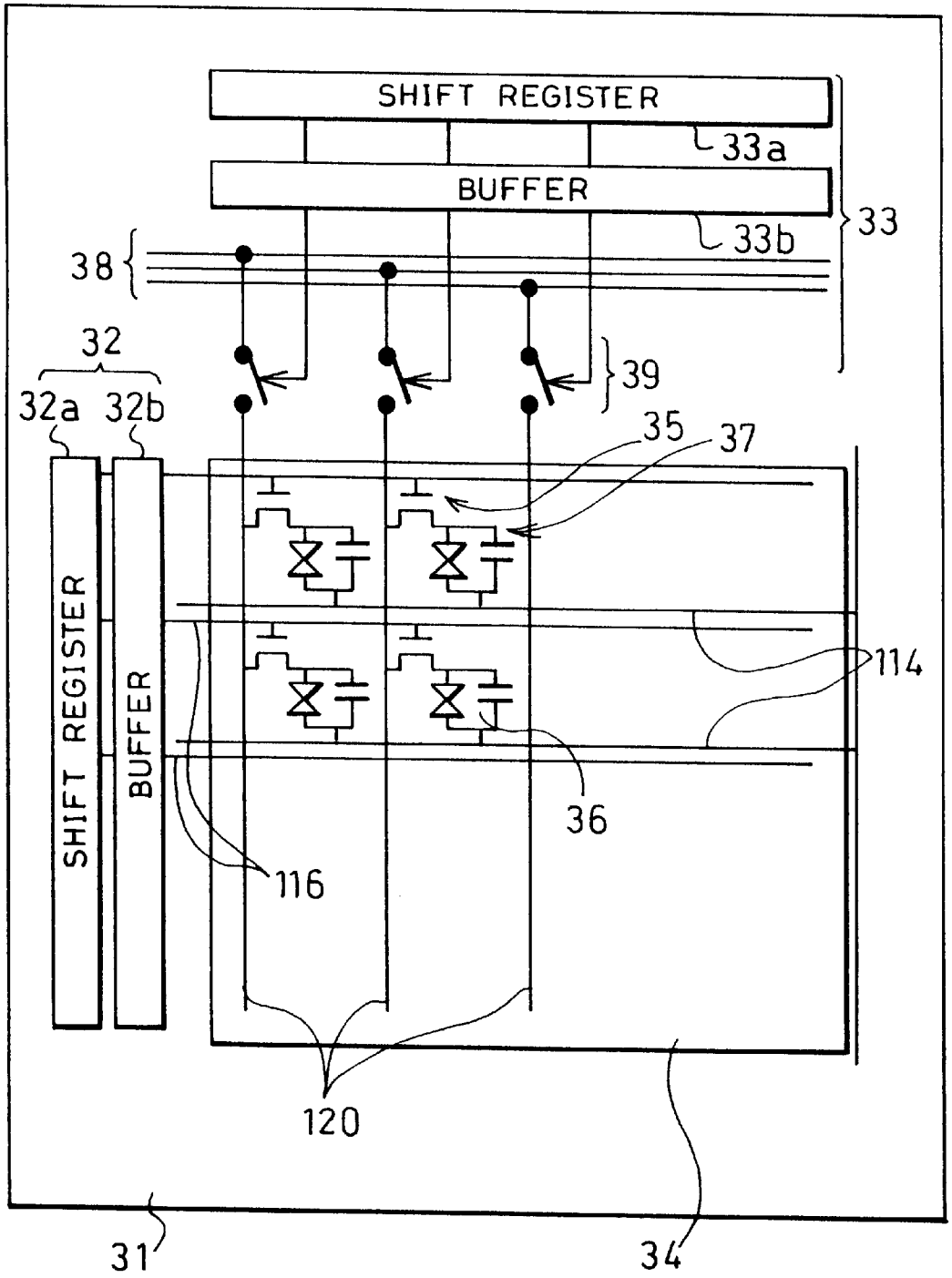
FIG. 8 is a view for explaining the structure of a conventional liquid crystal display device.
Figure 9:
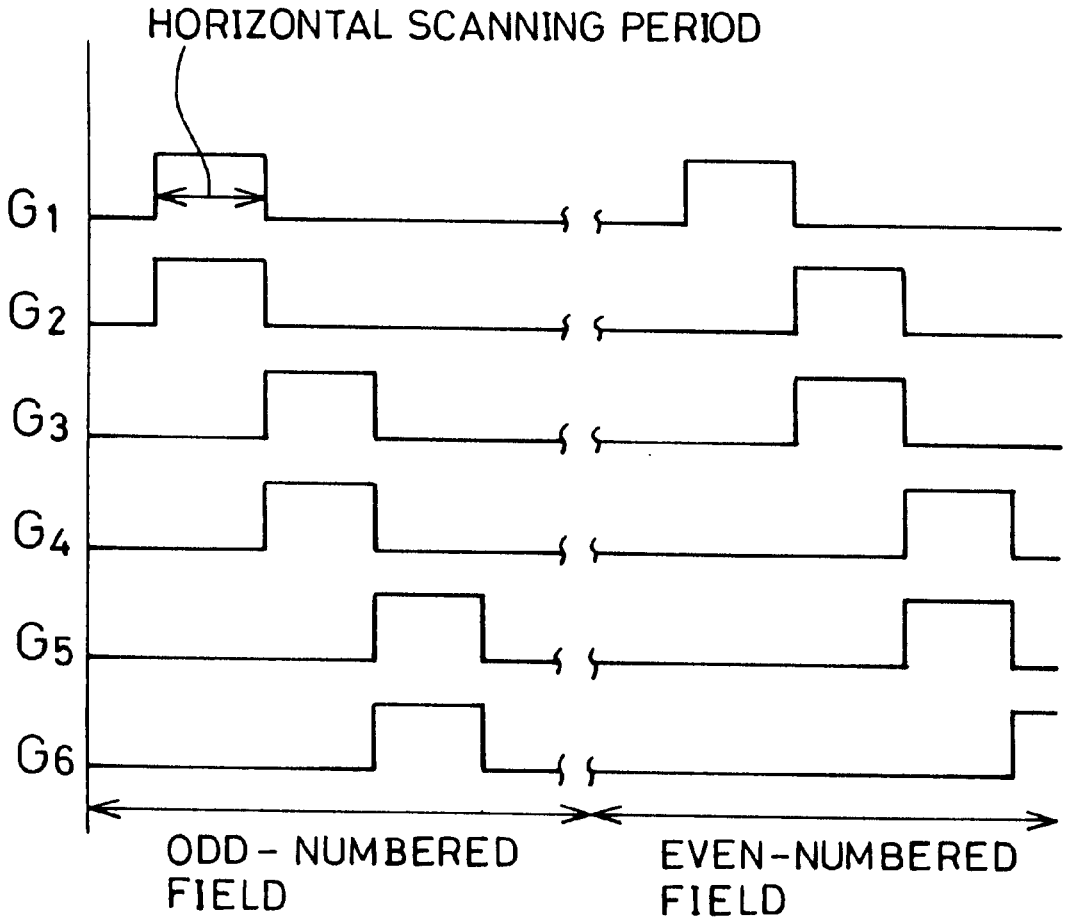
FIG. 9 is a waveform chart showing scanning signals to be applied to the gate buslines of the conventional liquid crystal display device.
Figure 10A:
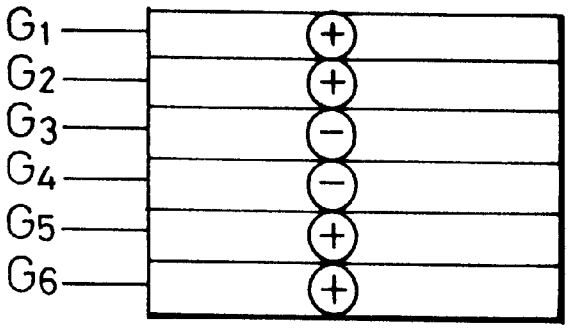
FIGS. 10(*a*) through 10(*d*) are views for explaining the inversion of the polarities of video signals to be fed to the pixel electrodes of the conventional liquid crystal display device.
Figure 10B:
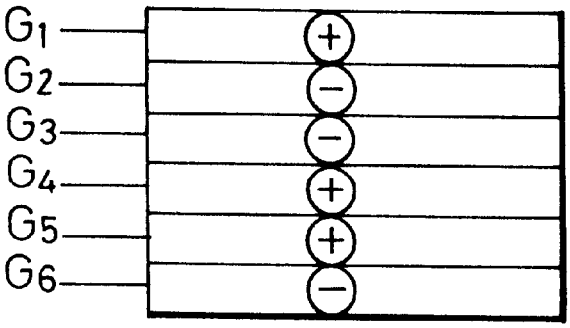
Figure 10C:
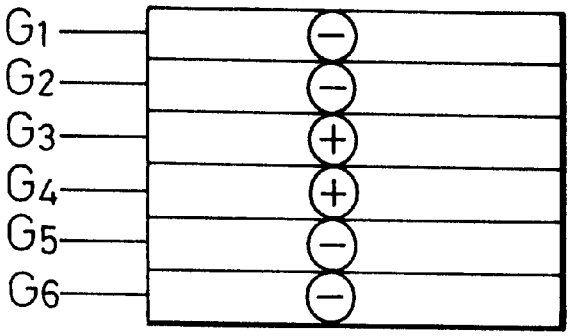
Figure 10D:
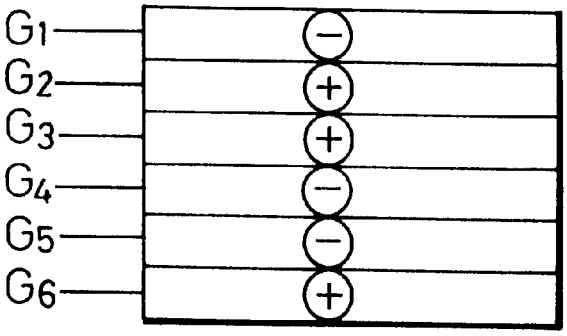

Referring to FIGS. 6 and 7, the following description will explain Embodiment 3 of the present invention. This embodiment is presented to explain a structure which is particularly suitable for the gate driver 3 used in Embodiments 1 and 2.

FIG. 6 is a view explaining the structure of a gate driver of a liquid crystal display device of this embodiment. FIG. 7 is a timing chart of various signals relating to driving of the liquid crystal display device of this embodiment.

As illustrated in FIG. 6, in this embodiment, the number of gate buslines $G_1$, $G_2$, $G_3$ . . . is 1024, and the signals output from one stage of scanning circuits GS-P GS-1 to GS-257 constituting the shift register 3*a* are fed to four of the gate buslines $G_1$, $G_2$, $G_3$ . . . By arranging the number of control signals to be four or more, the liquid crystal display device of this embodiment can scan two of the gate buslines $G_1$, $G_2$, $G_3$ . . . simultaneously. However, if the number of control signals is increased, the number of signal input terminals increases, and the mounting process becomes complicated. Therefore, it is preferred to input four control signals to multiplexer $MUX_1$, $MUX_2$ . . . constituting the multiplexer section 3*b*.

As illustrated in FIG. 6, the gate driver of the liquid crystal display device of this embodiment is formed by the scanning circuits GS-P, GS-1 to GS-257, AND gate circuits $AND_1$ to $AND_{256}$ constituting a first logical gate circuit, NAND gate circuits $NAND_1$ to $NAND_{1024}$ constituting a second logical gate circuit, and buffer circuits BF.

A start pulse SPG, clock signal CKG, and inverted clock signal /CKG are input to the scanning circuits GS-P, GS-1 to GS-257. Each of the scanning circuits GS-P, GS-1 to GS-257 sequentially shifts the start pulse SPG by an amount of a half of pulse in synchronization with the clock signal CKG.

The AND gate circuits $AND_1$ to $AND_{256}$ receive two adjacent output signals, for example, $Q_1 \cdot P_1$, $P_1 \cdot P_2$ . . . , of output signals $Q_1$, $P_1$ to $P_{256}$ from the scanning circuits GS-P, GS-1 to GS-257, as input signals.

The NAND gate circuits $NAND_1$ to $NAND_{1024}$ receive output signal $GPP_1$ to $GPP_{256}$ from the AND gate circuits $AND_1$ to $AND_{256}$, and control signals $GP_1$, $GP_2$, $GP_3$, $GP_4$ as input signals.

The buffer circuits EF receive output signals from the NAND gate circuits $NAND_1$ to $NAND_{1024}$ as input signals.

The NAND gate circuits $NAND_1$ to $NAND_{1024}$ correspond to the multiplexer section 3*b* shown in FIGS. 1 and 4.

Although it is not shown in any of the drawings, the outputs of the buffer circuits BF are input to the level shifter 3*c* to increase the voltage thereof, and then input to the gate buslines $G_1$ to $G_{1024}$.

The gate driver of this embodiment can reduce the number of control signals to be fed to the second logical gate circuit by providing the first logical gate circuit. In the case where the outputs of the scanning circuits GS-P, GS-1 to GS-257 are input as they are to the NAND gate circuits $NAND_1$ to $NAND_{1024}$ constituting the second logical gate circuit, without providing the first logical gate circuit, eight control signals are required.

The number of output signals from the first logical gate circuit is 256. The output signals from adjacent scanning circuits GS-P, GS-1 to GS-257 are input to the first logical gate circuit. Therefore, an extra stage of scanning circuit, i.e., scanning circuit GS-P, is provided before the shift register GS-1. The scanning circuit GS-P may be provided after the shift register GS-257.

Referring now to FIG. 7, the following description will explain the method of driving the liquid crystal display device of this embodiment when scanning two of the gate buslines $G_1$, $G_2$, $G_3$ . . . simultaneously.

Denoting a scanning line selecting period by T, a start pulse SPG with a pulse width of 4 T, clock signal CLK with a cycle of 4 T, and a signal /CLK as the inverted signal of the clock signal are input to the scanning circuits GS-P, GS-1 to GS-257. Then, outputs $Q_1$, $P_1$ to $P_{256}$ are output from the scanning circuits GS-P, GS-1 to GS-257.

Thereafter, outputs $Q_1 \cdot P_1$, $P_1 \cdot P_2$, to $P_{256} \cdot P_{256}$ from adjacent scanning circuits GS-P, GS-1 to GS-257 are input to the AND gate circuits $AND_1$ to $AND_{256}$ constituting the first logical gate circuit. Signals $GPP_1$, $GPP_2$ to $GPP_{256}$ having a pulse width half of the pulse width of the outputs $Q_1$, $P_1$ to $P_{256}$ from the scanning circuits GS-P, GS-1 to GS-257 are output from the AND gate circuits $AND_1$ to $AND_{256}$.

Next, the signals $GPP_1$, $GPP_2$ to $GPP_{256}$ are input to the NAND gate circuits $NAND_1$ to $NAND_{1024}$ as the second logical circuit. Four signals $GP_1$ to $GP_4$ shown in FIG. 6 are used as the control signals of the NAND gate circuits $NAND_1$ to $NAND_{1024}$. The number of control signals to be input to the multiplexer (second logical gate circuit) is a half of that of a structure where the first logical gate circuit is not provided. In order to scan two gate buslines simultaneously, it is necessary to arrange the number of control signals to be four or more.

In order to scan two gate buslines simultaneously, in an odd-numbered field, as shown in FIG. 7, a pulse with a cycle of 2 T is input to $GP_1$ and $GP_2$, and a pulse whose phase is displaced by an amount of T from the pulse input to $GP_1$ and $GP_2$ is input to $GP_3$ and $GP_4$.

Thus, a pulse having a pulse width of T and phase which is sequentially shifted by an amount of T, is generated every two scanning lines $G_1 \cdot G_2$, $G_3 \cdot G_4$, to $G_{1023} \cdot G_{1024}$ as an output signal from the buffer circuit BF. The voltage of the generated pulse is increased by the level shifter 3*c*, and then sequentially input to the gate buslines $G_1$, $G_2$, $G_3$ . . .

Although it is not shown in any of the drawings, in an even-numbered field, the pulse shown at $G_1$ and $G_2$ of FIG. 7 are generated at $G_2$ and $G_3$ as the output signal from the buffer circuit BF. Similarly, the pulse shown at $G_3$ and $G_4$ of FIG. 7 are generated at $G_4$ and $G_5$ as the output signal from the buffer circuit BF. Namely, in an even-numbered field, a pulse having a pulse width of T and phase shifted by an amount of T from the previous pulse, is generated every two scanning lines $G_2 \cdot G_3$, $G_4 \cdot G_5$ . . . which form pairs different from those of an odd-numbered field.

As described above, since the gate driver of this embodiment is provided with the circuit shown in FIG. 6, it is possible to scan two gate buslines simultaneously. Moreover, in the gate driver of this embodiment, the AND gate circuit and NAND gate circuit are used as the first logical gate circuit and second logical gate circuit, respectively. However, the AND gate circuit and NAND gate circuit are not necessarily limited to those circuits. For example, it is possible to use other logical gate circuits such as NOR gate circuit.

In Embodiments 1 to 3 described above, the polarity of the video signal is inverted every field. However, the present invention is also applicable to a liquid crystal display device in which the polarity of the video signal is inverted every vertical scanning period.

As described above, a liquid crystal display device of the present invention includes:

a first substrate having gate buslines, source buslines, switching elements which are arranged in the vicinity of the intersections of the gate buslines and source buslines so as to form a matrix pattern, and a pixel electrode array formed by pixel electrodes connected to the switching elements;

a gate driver and a source driver, for driving the switching elements;

a second substrate having a counter electrode formed thereon; and a liquid crystal material sandwiched between the first and second substrates, wherein the gate driver applies scanning signals simultaneously to two gate buslines located adjacent to each other, and the source driver applies video signals of opposite polarities to adjacent source buslines, respectively, and inverts the polarities of the video signals every vertical scanning period.

With this structure it is possible to significantly reduce flicker generated in the liquid crystal display device.

Moreover, a liquid crystal display device according to the present invention is constructed so that a plurality of video signal lines for feeding the video signals are provided, and the polarities of video signals to be input to the video signal lines are inverted every vertical scanning period.

With this structure, the liquid crystal display device eliminates the necessity of inverting the video signal every source busline, which is required in a liquid crystal display device having a single video signal line.

Furthermore, a liquid crystal display device according to the present invention is constructed so that the polarities of the video signals to be applied to the pixel electrodes in adjacent columns of the pixel array are opposite to each other.

With this structure, the liquid crystal display device can further reduce flicker as compared to a liquid crystal display device in which the polarity is inverted every source busline.

In addition, a liquid crystal display device according to the present invention is constructed so that the switching elements connected to the source buslines are positioned alternately on one side and the other side of the source buslines.

With this structure, the liquid crystal display device can easily invert the polarity in each pixel by simply changing the connecting position of the switching elements with respect to the pixel electrodes.

Besides, a liquid crystal display device according to the present invention is constructed so that the gate driver is formed on the first substrate.

With this structure, the liquid crystal display device does not require a complicated external driver IC for scanning two gate buslines simultaneously, thereby enabling fabrication of the gate driver in the process of forming the switching elements.

Additionally, a liquid crystal display device according to the present invention is constructed so that the gate driver includes a multiplexer which contributes to generation of scanning signals which scan gate buslines sequentially two gate buslines at a time.

With this structure, the liquid crystal display device can reduce the number of external input terminals.

A liquid crystal display device according to the present invention is constructed so that the gate driver includes between the shift register and multiplexer a logical gate circuit for reducing the number of signals input to the multiplexer to a half.

With this structure, the liquid crystal display device can reduce the number of control signals input to the multiplexer.

Furthermore, a liquid crystal display device according to the present invention is constructed so that the multiplexer has four control terminals.

With this structure, it is possible to perform simultaneous two-line scanning with the minimum number of control terminals of the multiplexer.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A liquid crystal display device comprising:

a first substrate having gate buslines, source buslines, switching elements which are arranged in the vicinity of intersections of said gate buslines and source buslines so as to form a matrix pattern, and a pixel electrode array formed by pixel electrodes connected to said switching elements;

a gate driver and a source driver, for driving said switching elements;

a second substrate having a counter electrode formed thereon; and a liquid crystal material sandwiched between said first and second substrates, wherein said gate driver applies scanning signals simultaneously to two gate buslines located adjacent to each other, said source driver applies video signals of opposite polarities to adjacent source buslines, respectively, and inverts the polarities of the video signals every vertical scanning period, the polarity of the video signals applied to the source buslines remains the same during one vertical scanning period, and said switching elements connected to said source buslines are positioned alternately on one side and the other side of said source buslines.

2. The liquid crystal display device as set forth in claim 1, further comprising a plurality of video signal lines for feeding the video signals, wherein the polarities of the video signals to be input to said video signal lines are inverted every vertical scanning period.

3. The liquid crystal display device as set forth in claim 2, wherein the polarities of the video signals to be applied to the pixel electrodes of adjacent columns of said pixel array are arranged to be opposite to each other.

4. The liquid crystal display device as set forth in claim 2, wherein said gate driver includes a multiplexer for contributing to generation of scanning signals which scan said gate buslines sequentially two gate buslines at a time.

5. The liquid crystal display device as set forth in claim 4, wherein said multiplexer includes four control terminals.

6. The liquid crystal display device as set forth in claim 1, wherein the polarities of the video signals to be applied to the pixel electrodes of adjacent columns of said pixel array are opposite to each other.

7. The liquid crystal display device as set forth in claim 6, wherein said gate driver includes a multiplexer for contributing to generation of scanning signals which scan said gate buslines sequentially two gate buslines at a time.

8. The liquid crystal display device as set forth in claim 7, wherein said multiplexer includes four control terminals.

9. The liquid crystal display device as set forth in claim 1, wherein said gate driver is formed on said first substrate.

10. The liquid crystal display device as set forth in claim 1, wherein said gate driver includes a multiplexer for contributing to generation of scanning signals which scan said gate buslines sequentially two gate buslines at a time.

11. The liquid crystal display device as set forth in claim 10, wherein said gate driver comprises:

a shift register; and a logical gate circuit, disposed between said shift register and said multiplexer, for reducing the number of signals to be input to said multiplexer to a half.

12. The liquid crystal display device as set forth in claim 10, wherein said multiplexer includes four control terminals.

13. The liquid crystal display device comprising:

a first substrate having gate buslines, source buslines, switching elements which are arranged in the vicinity of intersections of said gate buslines and source buslines so as to form a matrix pattern, and a pixel electrode array formed by pixel electrodes connected to said switching elements;

a gate driver and a source driver, for driving said switching elements;

a second substrate having a counter electrode formed thereon; and a liquid crystal material sandwiched between said first and second substrates, wherein said gate driver applies scanning signals simultaneously to two gate buslines located adjacent to each other, said source driver applies video signals of opposite polarities to adjacent source buslines, respectively, and inverts the polarities of the video signals every vertical scanning period, and said switching elements connected to said source buslines are positioned alternately on one side and the other side of said source buslines.

14. The liquid crystal display device as set forth in claim 13, wherein said gate driver includes a multiplexer for contributing to generation of scanning signals which scan said gate buslines sequentially to gate buslines at a time.

15. The liquid crystal display device as set forth in claim 14, wherein said multiplexer includes four control terminals.

16. A liquid crystal display device comprising:

a first substrate having gate buslines, source buslines, switching elements which are arranged in the vicinity of intersections of said gate buslines and source buslines so as to form a matrix pattern, and a pixel electrode array formed by pixel electrodes connected to said switching elements;

a gate driver and a source driver, for driving said switching elements;

a second substrate having a counter electrode formed thereon; and a liquid crystal material sandwiched between said first and second substrates, wherein said gate driver applies scanning signals simultaneously to two gate buslines located adjacent to each other, said source driver applies video signals of opposite polarities to adjacent source buslines, respectively, and inverts the polarities of the video signals every vertical scanning period, and wherein said gate driver comprises:

a shift register including m/4 scanning circuits and one extra scanning circuit, m being the number of said gate buslines, a first logical circuit including m/4 output terminals corresponding to said m/4 scanning circuits, and outputs an ON signal from an output terminal corresponding to one scanning circuit when both of the output of said one scanning circuit and an output of a scanning circuit adjacent to said one scanning circuit are ON signals; and a second logical circuit formed by m/4 multiplexers, phases of the outputs from said scanning circuits of said shift register are shifted by an amount of a half of a pulse width of the ON signal, and first to fourth control signals having a cycle equal to the pulse width of the ON signal output from said first logical circuit are input to said multiplexers, respectively, the first and second control signals having an equal phase, the third and fourth control signals having a phase shifted by ½ cycle from the phase of the first and second control signals.

17. A liquid crystal display device comprising:

a first substrate having gate buslines, source buslines, switching elements which are arranged in the vicinity of intersections of said gate buslines and source buslines so as to form a matrix pattern, and a pixel electrode array formed by pixel electrodes connected to said switching elements;

a gate driver and a source driver, for driving said switching elements;

a second substrate having a counter electrode formed thereon; and a liquid crystal material sandwiched between said first and second substrates, wherein said gate driver applies scanning signals simultaneously to two gate buslines located adjacent to each other, said source driver includes video signal lines of two kinds having polarities that are opposite to each other and that are inverted every vertical scanning period, each of the two kinds of said video signal lines including at least one video signal line, one source busline of an arbitrary pair of two adjacent source buslines is connected with a video signal line of one kind, and the other source busline of said pair is connected with a video signal line of the other kind, so that video signals of opposite polarities are applied to said source buslines of said pair, respectively, and said switching elements connected to said source buslines are positioned alternately on one side and the other side of said source buslines.

18. The liquid crystal display device as set forth in claim 17, wherein the polarities of the video signals to be applied to the pixel electrodes of adjacent columns of said pixel array are opposite to each other.

19. The liquid crystal display device as set forth in claim 18, wherein said gate driver includes a multiplexer for contributing to generation of scanning signals which scan said gate buslines sequentially two gate buslines at a time.

20. The liquid crystal display device as set forth in claim 19 wherein said multiplexer includes four control terminals.

21. The liquid crystal display device as set forth in claim 17, wherein said gate driver is formed on said first substrate.

22. The liquid crystal display device as set forth in claim 17, wherein said gate driver includes a multiplexer for contributing to generation of scanning signals which scan said gate buslines sequentially two gate buslines at a time.

23. The liquid crystal display device as set forth in claim 22, wherein said gate driver comprises:

a shift register; and a logical gate circuit, disposed between said shift register and said multiplexer, for reducing the number of signals to be input to said multiplexer by half.

24. The liquid crystal display device as set forth in claim 22, wherein said multiplexer includes four control terminals.

25. A liquid crystal display device comprising:

a first substrate having gate buslines, source buslines, switching elements which are arranged in the vicinity of intersections of said gate buslines and source buslines so as to form a matrix pattern, and a pixel electrode array formed by pixel electrodes connected to said switching elements;

a gate driver and a source driver, for driving said switching elements;

a second substrate having a counter electrode formed thereon; and a liquid crystal material sandwiched between said first and second substrates, wherein said gate driver applies scanning signals simultaneously to two gate buslines located adjacent to each other, said source driver includes video signal lines of two kinds having polarities that are opposite to each other and that are inverted every vertical scanning period, each of the two kinds of said video signal lines including at least one video signal line, one source busline of an arbitrary pair of two adjacent source buslines is connected with a video signal line of one kind, and the other source busline of said pair is connected with a video signal line of the other kind, so that video signals of opposite polarities are applied to said source buslines of said pair, respectively, and wherein said gate driver comprises:

a shift register including m/4 scanning circuits and one extra scanning circuit, m being the number of said gate buslines, a first logical circuit including m/4 output terminals corresponding to said m/4 scanning circuits, and outputs an ON signal from an output terminal corresponding to one scanning circuit when both of the output of said one scanning circuit and an output of a scanning adjacent to said one scanning circuit are ON signals; and a second logical circuit formed by m/4 multiplexers, phases of the outputs from said scanning circuits of said shift register are shifted by an amount of a half of a pulse width of the ON signal, and first to fourth control signals having a cycle equal to the pulse width of the ON signal output from said first logical circuit are input to said multiplexers, respectively, the first and second control signal having an equal phase, the third and fourth control signals having a phase shifted by one-half cycle from the phase of the first and second control signals.

26. A liquid crystal display device comprising:

a pair of spaced apart substrates with a liquid crystal layer interposed therebetween;

a matrix of parallel gate buslines and parallel source buslines arranged on one of said substrates;

pixel electrodes connected to said gate buslines and said source buslines; and a gate driver and a source driver for driving said gate buslines and said source buslines; and a video signal line pair to which video signals of opposite polarity are applied, wherein each of said source buslines is connected to one of said video signal lines via a switch, first alternate ones of said source buslines are connected to a first one of the video signal line pair and second alternate ones of said source buslines are connected to a second one of the video signal line pair, said gate driver drives said gate buslines by applying scanning signals simultaneously to two adjacent ones of said gate buslines, said source driver drives said source buslines by applying video signals of opposite polarities to adjacent source buslines and by reversing the polarity of the video signals applied to each of the source buslines every vertical scanning period, and said source driver comprises a shift register and the on/off control of said switches is based on outputs of said shift register.

27. A liquid crystal display device comprising:

a pair of spaced apart substrates with a liquid crystal layer interposed therebetween;

a matrix of parallel gate buslines and parallel source buslines arranged on one of said substrates;

pixel electrodes connected to said gate buslines and said source buslines; and a gate driver and a source driver for driving said gate buslines and said source buslines; wherein said gate driver drives said gate buslines by applying scanning signals simultaneously to two adjacent ones of said gate buslines, said source driver drives said source buslines by applying video signals of opposite polarities to adjacent source buslines and by reversing the polarity of the video signals applied to each of the source buslines every vertical scanning period, and each source busline is alternately connected to pixel electrodes on opposite sides thereof.

28. A liquid crystal display device comprising:

a pair of spaced apart substrates with a liquid crystal layer interposed therebetween;

a matrix of parallel gate buslines and parallel source buslines arranged on one of said substrates;

pixel electrodes connected to said gate buslines and said source buslines; and a gate driver and a source driver for driving said gate buslines and said source buslines; wherein said gate driver drives said gate buslines by applying scanning signals simultaneously to two adjacent ones of said gate buslines, said source driver drives said source buslines by applying video signals of opposite polarities to adjacent source buslines and by reversing the polarity of the video signals applied to each of the source buslines every vertical scanning period, and said gate driver comprises:

scanning circuits;

first logic circuits each logically combining outputs of two of said scanning circuits; and second logic circuits each logically combining an output of one of said first logic circuits and a control signal and outputting a scanning signal to a respectively corresponding one of said source buslines in accordance with the logical combination.

29. The liquid crystal display device as set forth in claim 28, wherein the output of each first logic circuit is provided to more than one second logic circuit.

* * * * *